US008196753B2

(12) United States Patent
Freissle

(10) Patent No.: US 8,196,753 B2
(45) Date of Patent: Jun. 12, 2012

(54) SCREENING PANEL

(75) Inventor: Peter Helmut Franz Freissle, Spartanburg, SC (US)

(73) Assignee: Polydeck Screen Corporation, Spartanburg, SC (US)

( * ) Notice: Subject to any disclaimer, the term of this patent is extended or adjusted under 35 U.S.C. 154(b) by 0 days.

(21) Appl. No.: 12/944,835

(22) Filed: Nov. 12, 2010

(65) Prior Publication Data

US 2012/0118796 A1 May 17, 2012

(51) Int. Cl.
*B07B 1/46* (2006.01)

(52) U.S. Cl. ..... 209/401; 209/392

(58) Field of Classification Search ..... 209/392, 209/393, 400, 401

See application file for complete search history.

(56) References Cited

U.S. PATENT DOCUMENTS

| | | | | | |
|---|---|---|---|---|---|
| 305,299 | A | * | 9/1884 | Edwards | 209/401 |
| 485,488 | A | * | 11/1892 | Cockrell | 99/607 |
| 750,167 | A | * | 1/1904 | Clement | 209/393 |
| 4,265,742 | A | | 5/1981 | Bücker et al. | |
| 4,819,809 | A | | 4/1989 | Derrick | |
| 4,882,044 | A | | 11/1989 | Freissle | |
| 5,415,294 | A | | 5/1995 | Nagaoka | |
| 5,417,859 | A | * | 5/1995 | Bakula | 210/388 |
| 5,598,930 | A | * | 2/1997 | Leone et al. | 209/403 |
| 5,927,511 | A | | 7/1999 | Riddle et al. | |
| 6,032,806 | A | * | 3/2000 | Leone et al. | 209/402 |
| 6,450,345 | B1 | | 9/2002 | Adams et al. | |
| 6,454,099 | B1 | * | 9/2002 | Adams et al. | 209/399 |
| 7,413,087 | B2 | | 8/2008 | Kriel | |
| 7,621,406 | B2 | | 11/2009 | Freissle et al. | |
| 7,735,654 | B2 | * | 6/2010 | Malmberg | 209/263 |
| 7,857,142 | B2 | * | 12/2010 | Waites, Jr. | 209/405 |
| 2005/0040083 | A1 | | 2/2005 | Freissle et al. | |
| 2010/0025307 | A1 | | 2/2010 | Freissle et al. | |

OTHER PUBLICATIONS

PCT Search Report and Written Opinion for PCT/US2011/045499, dated Dec. 30, 2011.

* cited by examiner

*Primary Examiner* — Joseph C Rodriguez
(74) *Attorney, Agent, or Firm* — Dority & Manning, P.A.

(57) ABSTRACT

A screening panel is provided for screening particulate materials. The screening panel includes a peripheral frame and a plurality of ribs. The peripheral frame has an upper surface, a lower surface, and an outer peripheral surface interconnecting the upper surface and lower surface. Further, the peripheral frame defines an opening. The ribs extend across the opening and define a screening surface. Each of the plurality of ribs has a substantially flat upper surface. The screening panel further includes at least one generally arcuate raised member extending from the upper surface of each of the plurality of ribs. The raised members facilitate screening the particulate materials.

20 Claims, 4 Drawing Sheets

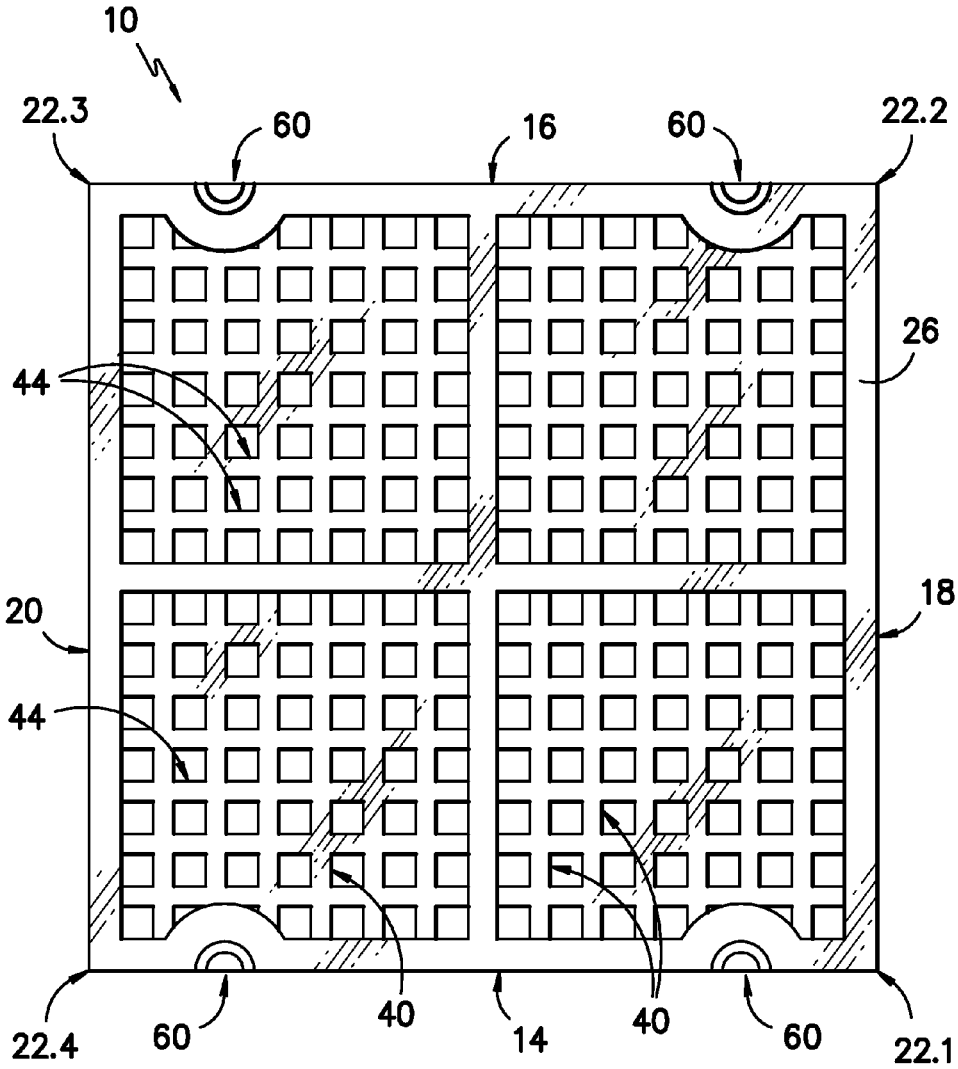
FIG. —3—

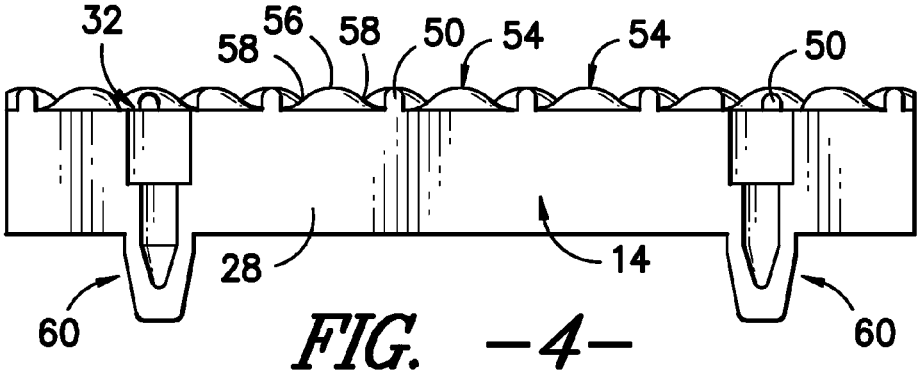
FIG. —4—
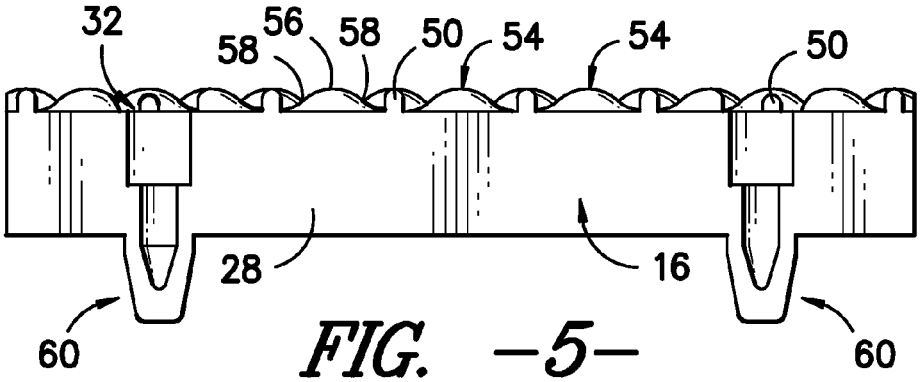
FIG. —5—
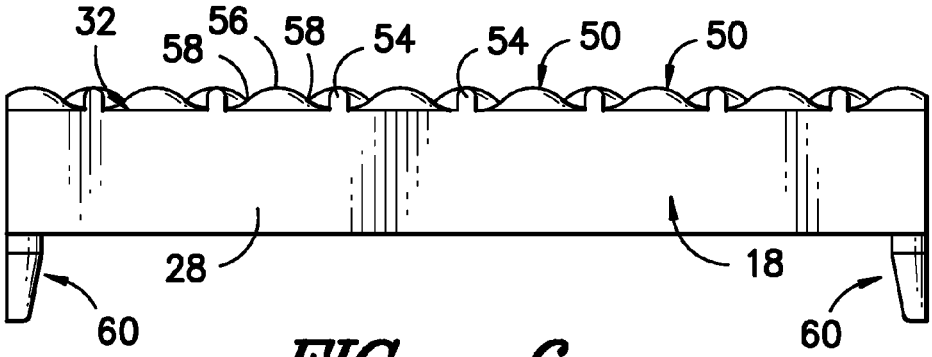
FIG. —6—
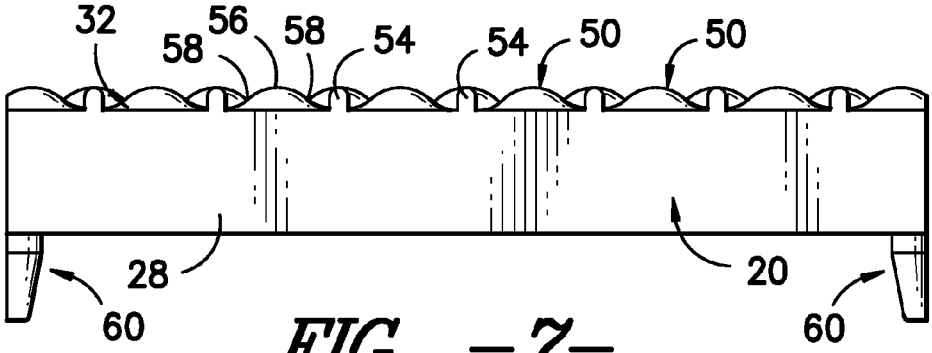
FIG. —7—

SCREENING PANEL

FIELD OF THE INVENTION

The present disclosure relates in general to screening panels, and more specifically to screening panels that include raised members to facilitate screening particulate materials.

BACKGROUND OF THE INVENTION

Screening arrangements are used in the mining and similar industries to size and separate, or screen, particulate materials. Certain screening arrangements include modular screening systems which are composed of a plurality of modular and replaceable components, such as screening panels.

Current screening panels generally include a plurality of ribs extending across an opening. The ribs define a screening surface through which particulate material is directed. As the particulate material is directed through the screening surface, relatively larger material particles are prevented by the ribs from passing through the screening surface, while relatively smaller material particles are allowed to pass through the screening surface. Thus, the particulate materials are screened by the screening panels.

Examples of screening panels and screening arrangements are disclosed in, for example, U.S. Pat. No. 7,621,406 to Freissle et al. and U.S. Patent Appl. Pub. No. 2010/0025307 to Freissle et al. The subject matter of each of the above-referenced issued patents and published applications is fully incorporated herein by reference, and for all purposes.

However, current screening panels have several disadvantages. For example, the screening surfaces of current screening panels are generally flat, planer surfaces. These flat surfaces may prevent particulate materials from being properly screened. For example, relatively smaller material particles which should desirably pass through the screening surface may contact the flat screening surface, and the flat surface may prevent the material particles from passing through the screening surface. Further, relatively smaller material particles may, during the screening process, be delayed from screening by the flat screening surface, thus resulting in a relatively inefficient screening process.

Thus, a need exists for a screening panel that allows for more efficient screening of particulate materials. Further, a screening panel that includes features that facilitate screening of particulate materials would be advantageous.

BRIEF DESCRIPTION OF THE INVENTION

Aspects and advantages of the invention will be set forth in part in the following description, or may be obvious from the description, or may be learned through practice of the invention.

In one embodiment, a screening panel is provided for screening particulate materials. The screening panel includes a peripheral frame and a plurality of ribs. The peripheral frame has an upper surface, a lower surface, and an outer peripheral surface interconnecting the upper surface and lower surface. Further, the peripheral frame defines an opening. The ribs extend across the opening and define a screening surface. Each of the plurality of ribs has a substantially flat upper surface. The screening panel further includes at least one generally arcuate raised member extending from the upper surface of each of the plurality of ribs. The raised members facilitate screening the particulate materials.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWING

A full and enabling disclosure of the present invention, including the best mode thereof, directed to one of ordinary skill in the art, is set forth in the specification, which makes reference to the appended figures, in which:

FIG. 3 is a bottom view of one embodiment of the screening panel of the present disclosure;

FIG. 4 is front side view of one embodiment of the screening panel of the present disclosure;

FIG. 5 is a back side view of one embodiment of the screening panel of the present disclosure;

FIG. 6 is a left side view of one embodiment of the screening panel of the present disclosure; and FIG. 7 is a right side view of one embodiment of the screening panel of the present disclosure.

DETAILED DESCRIPTION OF THE INVENTION

Figure 1:
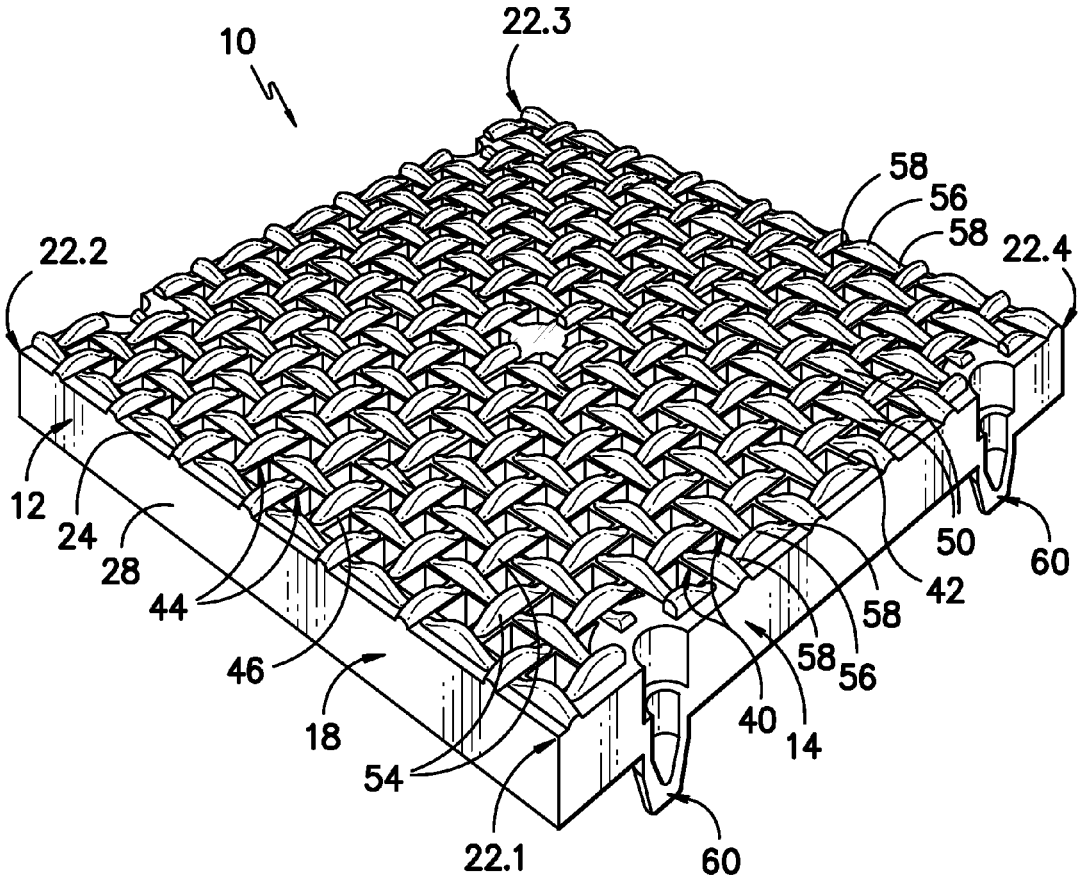
FIG. 1 is a perspective view of one embodiment of the screening panel of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure is directed in general to a screening panel including a plurality of ribs defining a screening surface and a plurality of raised members extending from the upper surfaces of the ribs. The raised members generally facilitate the screening of particulate materials. For example, the raised members may generally direct particulate materials towards and through the screening surface of the screening panel. Further, in exemplary embodiments, the raised members may be formed from a resiliently deformable material. During the screening process, the screening panel may be vibrated or shaken. As the screening panel is vibrated, the vibratory force may cause the ribs and the resilient raised members to bend or flex relative to the screening panel. This movement of the ribs and raised members may further facilitate the screening of particulate materials by causing the particulate materials to move towards the screening surface. In particular, each of the ribs and associated raised members may bend and flex independently of other ribs and raised members. For example, each of the ribs and associated raised members may bend and flex to screen the particulate materials during the screening process. Further, each rib, along with the associated raised members, may advantageously develop independent bending and flexing movement relative to other ribs and associated raised members. This independent bending and flexing of each rib and associated raised member may advantageously facilitate screening of the particulate materials.

Referring to FIGS. 1 through 7, for example, one embodiment of a screening panel 10 of the present disclosure is shown. The screening panel 10 may include a peripheral frame 12. The peripheral frame 12 may include, for example, a pair of laterally spaced frame members 14 and 16. The frame members 14 and 16 may be integral with, for example, a pair of mutually axially spaced frame side members 18 and 20. The members 14, 16, 18, 20 may define corners 22.1, 22.2, 22.3, and 22.4 of the peripheral frame 12. Thus, the peripheral frame 12 may be a generally rectangular or square frame. It should be understood, however, that the peripheral frame 12 is not limited to a rectangular or square frame including members 14, 16, 18, 20, but may be a triangular frame, a circular or oval frame, or a frame with any polygonal shape.

The peripheral frame 12 may generally have an upper surface 24, a lower surface 26, and an outer peripheral surface 28. The outer peripheral surface 28 may generally interconnect the upper surface 24 and the lower surface 26. The peripheral frame 12 may define an opening 30 therein.

The screening panel 10 may further include a plurality of ribs 40. The ribs 40 may extend across the opening 30 and generally define a screening surface 32. Each of the plurality of ribs 40 may have a substantially flat upper surface 42. The plurality of ribs 40 may be included in the screening panel 10 in a variety of configurations. For example, in one embodiment, the ribs 40 may be generally parallel to one another. Further, the ribs 40 may extend across the screening panel 10 generally parallel to the frame members 14 and 16, or generally parallel to the frame side members 18 and 20. Alternatively, the ribs 40 may extend across the screening panel 10 generally diagonally or at an angle to the frame members 14 and 16 or the frame side members 18 and 20. In alternative embodiments, the ribs 40 may have a zig-zag configuration or any other desired configuration. The ribs 40 may have varying widths and lengths.

The screening panel 10 may further include a plurality of cross-ribs 44. The cross-ribs 44 may extend across the opening 30 and further define the screening surface 32. Each of the plurality of cross-ribs 44 may have a substantially flat upper surface 46. The plurality of cross-ribs 44 may be included in the screening panel 10 in a variety of configurations. For example, in one embodiment, the cross-ribs 44 may be generally parallel to one another. Further, the cross-ribs 44 may extend across the screening panel 10 generally parallel to the frame members 14 and 16, or *generally parallel to the frame side members 18 and 20. Alternatively, the cross-ribs 44 may extend across the screening panel 10 generally diagonally or at an angle to the frame members 14 and 16 or the side frame members 18 and 20. In alternative embodiments, the cross-ribs 44 may have a zig-zag configuration or any other desired configuration. The cross-ribs 44 may have varying widths and lengths.

In exemplary embodiments, the cross-ribs 44 may extend across the opening 30 generally perpendicularly to the ribs 40. Alternatively, however, the cross-ribs 44 may extend across the opening 30 generally at any angle with respect to the ribs 40.

The screening panel 10 of the present disclosure may further include at least one raised member 50 extending from the upper surface 42 of each of the plurality of ribs 40. Further, in exemplary embodiments, the screening panel 10 may include a plurality of raised members 50 extending from the upper surface 42 of each of the plurality of ribs 40. It should be understood, however, that each of the ribs 40 need not include a raised member 50. The raised members 50 may facilitate the screening of particulate material (not shown) through the screening panel 10. For example, the raised members 50 may direct particulate materials towards and through the screening surface 32 of the screening panel 10. Further, the raised members 50 may bend or flex relative to the screening panel 10 when the screening panel 10 is vibrated or shaken. This movement of the raised members 50 may further facilitate the screening of particulate materials by causing the particulate materials to move towards the screening surface 32.

Further, the screening panel 10 of the present disclosure may include at least one raised cross-member 54 extending from the upper surface 46 of each of the plurality of cross-ribs 44. Further, in exemplary embodiments, the screening panel 10 may include a plurality of raised cross-member 54 extending from the upper surface 46 of each of the plurality of cross-ribs 44. It should be understood, however, that each of the cross-ribs 44 need not include a raised cross-member 54. The raised cross-member 54 may facilitate the screening of particulate material through the screening panel 10. For example, the raised cross-members 54 may direct particulate materials towards and through the screening surface 32 of the screening panel 10. Further, the raised cross-members 54 may bend or flex relative to the screening panel 10 when the screening panel 10 is vibrated or shaken. This movement of the raised cross-members 54 may further facilitate the screening of particulate materials by causing the particulate materials to move towards the screening surface 32.

It should be understood that each of the raised members 50 and raised cross-members 54 is independent of any other raised members 50 and raised cross-members 54. Thus, each individual raised member 50 and raised cross-member 54 may bend and flex independently of other raised members 50 and raised cross-members 54 when the screening panel 10 is vibrated, beneficially causing particulate materials to move towards the screening surface 32 and facilitating screening of the particulate materials.

Each of the ribs 40, cross-ribs 44, raised members 50 and raised cross-members 54 may provide a particular benefit with regard to screening particulate materials by moving, such as bending and flexing, in a manner independent of the movement of other ribs 40, cross-ribs 44, raised members 50, and raised cross-members 54. For example, when the screening panel 10 is vibrated, each of the ribs 40 and cross-ribs 44, along with the associated raised members 50 and raised cross-members 54 extending therefrom, may bend and flex, thus screening the particulate materials. Further, each of the ribs 40 and cross-ribs 44, along with the associated raised members 50 and raised cross-members 54, may develop bending and flexing movements independent of the other ribs 40, cross-ribs 44, and associated raised member 50 and raised cross-members 54, when the screening panel 10 is vibrated. Thus, each rib 40 and cross-rib 44, along with the associated raised members 50 and raised cross-members 54, may bend and flex with respect to the other ribs 40, cross-ribs 44, raised members 50, and raised cross-members 54. This independent movement may advantageously cause particulate materials to move towards the screening surface 32 and further facilitate screening of the particulate materials.

In exemplary embodiments, the raised members 50 and raised cross-members 54 may be generally arcuate. In some exemplary embodiments, the raised members 50 and raised cross-members 54 may each include a generally convex portion 56. Further, in some exemplary embodiments, the raised members 50 may include at least one generally concave portion 58. In further exemplary embodiments, several or all of the raised members 50 and raised cross-members 54 may include two generally concave portions 58. However, it should be understood that the raised members 50 and raised cross-members 54 of the present disclosure are not limited to arcuate or convex and concave shapes. For example, in alternative embodiments, the raised members 50 and raised cross-members 54 may be axially extending protrusions, fin-shaped protrusions, chevron-shaped protrusions, ring-shaped protrusions, triangular-, pyramidal-, or prism-shaped protrusions, or may have any other suitable shape. It should further be understood that any of the members 50 and cross-members 54 may have different shapes from any other of the members 50 and cross-members 54.

Figure 2:
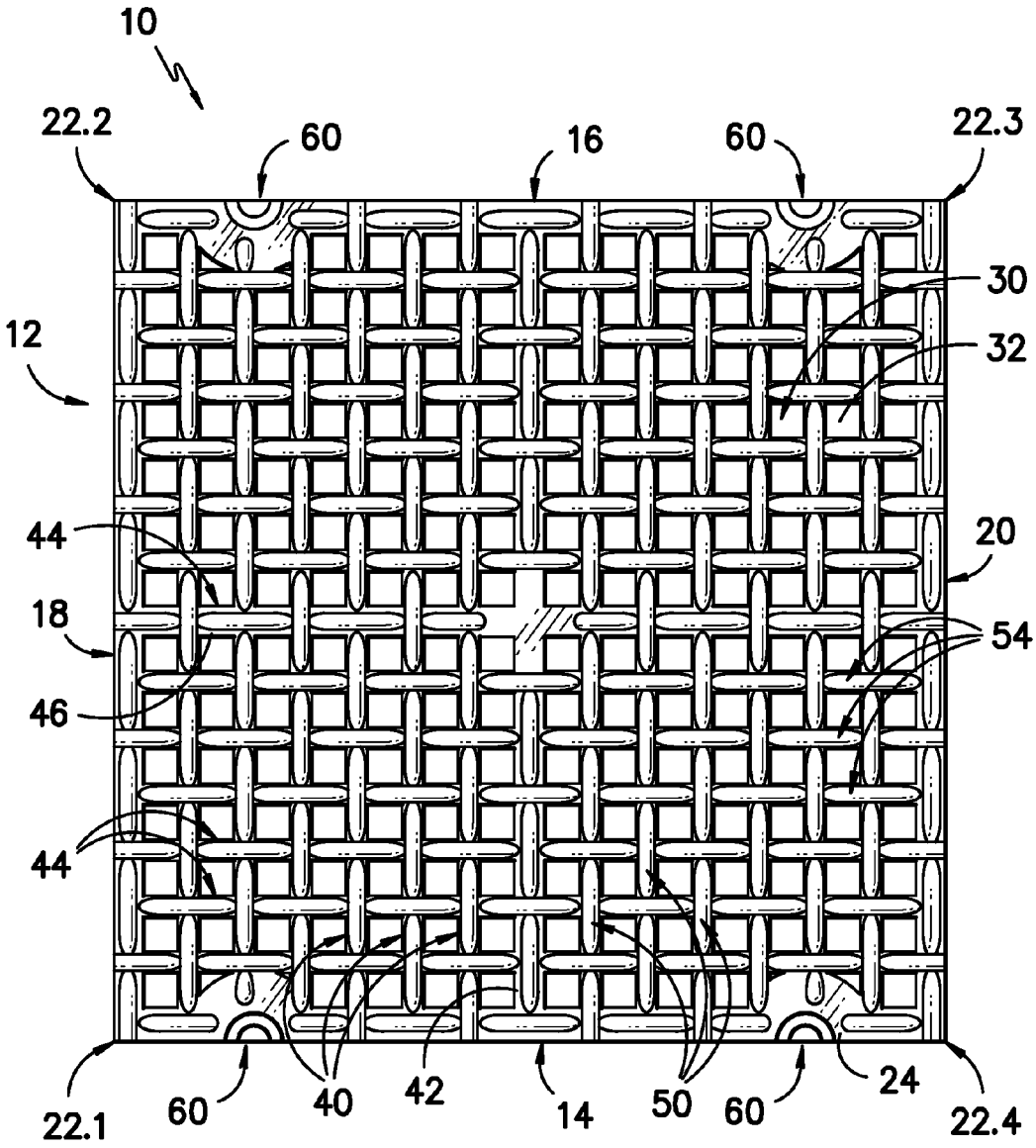
FIG. 2 is a top view of one embodiment of the screening panel of the present disclosure.

In exemplary embodiments, the raised members 50 and the raised cross-members 54 may be disposed adjacent one another. For example, as shown in FIGS. 1 and 2, each of the plurality of raised members 50 may be disposed adjacent at least one of the plurality of raised cross-members 54. Thus, the raised members 50 may partially extend from the upper surfaces 46 of the cross-ribs 44 at the various intersections of the ribs 40 and cross-ribs 44, and the raised cross-members 54 may partially extend from the upper surfaces 42 of the ribs 40 at the various intersections of the ribs 40 and cross-ribs 44. During a screening process, when the screening panel 10 is being vibrated or shaken, the raised members 50 and raised cross-members 54 may generally interact with adjacent raised members 50 and raised cross-members 54 to beneficially facilitate the screening of particulate material through the screening panel 10. For example, the adjacent raised members 50 and raised cross-members 54 may provide various pathways to direct particulate material towards and through the screening surface 32. Further, the raised members 50 and raised cross-members 54 may bend or flex in varying, dissimilar directions when the screening panel 10 is vibrated or shaken, and this varying, dissimilar movement may further facilitate the screening of particulate materials by causing the particulate materials to move towards the screening surface 32.

In exemplary embodiments, the peripheral frame 12 may include a plurality of the raised members 50. Further, the peripheral frame 12 may include a plurality of the raised cross-members 54. The raised members 50 and raised cross-members 54 may extend from the upper surface 24 of the peripheral frame 12. Further, in certain embodiments, several of the raised members 50 and raised cross-members 54 included on the peripheral frame 12 may extend from the ribs 40 and the cross-ribs 44 to the peripheral frame 12. The raised members 50 and cross-members 54 may extend from the upper surface 24 on any of the frame members 14, 16 and frame side members 18, 20. The raised members 50 and raised cross-members 54 included on the peripheral frame 12 may beneficially prevent particulate materials from becoming wedged and embedded between adjacent screening panels 10 or stuck on the peripheral frame 12, and may facilitate screening the particulate materials as discussed above.

In exemplary embodiments, the screening panel 10, including the raised members 50 and raised cross-members 54, may be formed of a resiliently deformable material. For example, in various embodiments, the resiliently deformable material may be a resiliently deformable polymeric material. In certain embodiments, the resiliently deformable material may include polyurethane. Further, in certain embodiments, the resiliently deformable material may include rubber. However, it should be understood that the present disclosure is not limited to the above disclosed materials. Rather, any suitable polymeric material or resiliently deformable material is within the scope and spirit of the present disclosure. Further it should be understood that the various components of the screening panel 10, such as the ribs 40, cross-ribs 44, raised members 50, and raised cross-members 54, need not be formed of the same material, but rather may be formed from varying materials having varying desirable resilience characteristics.

The screening panel 10 material may, in certain embodiments, have a Shore hardness in the range from approximately 40 Shore A to approximately 90 Shore A. In other embodiments, the screening panel 10 material may have a Shore hardness in the range from approximately 60 Shore A to approximately 85 Shore A. However, it should be understood that the screening panel 10 material of the present disclosure is not limited to Shore hardnesses in the range from approximately 40 Shore A to approximately 90 Shore A or approximately 60 Shore A to approximately 85 Shore A, but may be a material with any hardness above or harder than 90 Shore A or below or softer than 40 Shore A. Further it should be understood that the various components of the screening panel 10, such as the ribs 40, cross-ribs 44, raised members 50, and raised cross-members 54, need not be formed of the same material, but rather may be formed from varying materials having varying desirable hardnesses.

The screening panel 10 of the present disclosure may further include locating formations 60 provided on the peripheral frame 12. The locating formations 60 may be provided for engagement with complementary formations 60 on adjacent screening panels 10 to locate the screening panels 10 on a screen support frame (not shown). In some embodiments, the locating formations 60 may be protrusions, as shown in FIGS. 1 through 7. Complementary protrusions may be brought into register with one another and fit into securing devices (not shown) on the screen support frame. Securing pins (not shown) may then be knocked into bores formed by the complementary protrusions, to secure the adjacent screening panels 10 on the screen support frame. In other embodiments, the locating formations 60 may be recesses. Complementary recesses may be brought into register with one another, defining locating sockets into which complementary-shaped protrusions or spigots (not shown) are received to locate adjacent screening panels 10 on the screen support frame.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A screening panel for screening particulate materials, the screening panel comprising:

a peripheral frame, the peripheral frame having an upper surface, a lower surface, and an outer peripheral surface interconnecting the upper surface and lower surface, the peripheral frame defining an opening;

a plurality of ribs extending across the opening and defining a screening surface, each of the plurality of ribs having a substantially flat upper surface;

at least one cross-rib extending across the opening and further defining the screening surface, the cross-rib having a substantially flat upper surface;

at least one generally arcuate raised member extending from the upper surface of each of the plurality of ribs; and at least one raised cross-member extending from the upper surface of the cross-rib, wherein the raised members facilitate screening the particulate materials.

2. The screening panel of claim 1, wherein the at least one raised member is a plurality of raised members.

3. The screening panel of claim 1, wherein the at least one raised member includes a generally convex portion.

4. The screening panel of claim 3, wherein the at least one raised member further includes at least one generally concave portion.

5. The screening panel of claim 1, wherein the at least one cross-rib is a plurality of cross-ribs.

6. The screening panel of claim 5, wherein the cross-ribs extend across the opening generally perpendicularly to the ribs.

7. The screening panel of claim 5, wherein the at least one raised cross-member is a plurality of raised cross-members.

8. The screening panel of claim 7, wherein the at least one raised cross-member is a plurality of raised cross-members.

9. The screening panel of claim 7, wherein the at least one raised cross-member is generally arcuate.

10. The screening panel of claim 7, wherein the at least one raised cross-member includes a generally convex portion and at least one generally concave portion.

11. The screening panel of claim 1, wherein the screening panel is formed of a resiliently deformable polymeric material.

12. The screening panel of claim 11, wherein the resiliently deformable material includes polyurethane.

13. The screening panel of claim 11, wherein the resiliently deformable material includes rubber.

14. A screening panel for screening particulate materials, the screening panel comprising:

a peripheral frame, the peripheral frame having an upper surface, a lower surface, and an outer peripheral surface interconnecting the upper surface and lower surface, the peripheral frame defining an opening;

a plurality of ribs extending across the opening and defining a screening surface, each of the plurality of ribs having a substantially flat upper surface;

a plurality of cross-ribs extending across the opening and further defining the screening surface, each of the plurality of cross-ribs having a substantially flat upper surface;

a plurality of generally arcuate raised members extending from the upper surface of each of the plurality of ribs; and a plurality of generally arcuate raised cross-members extending from the upper surface of each of the plurality of cross-ribs, wherein the raised members and raised cross-members facilitate screening the particulate materials.

15. The screening panel of claim 14, wherein the raised members and raised cross-members each include a generally convex portion.

16. The screening panel of claim 15, wherein the raised members and raised cross-members each further include at least one generally concave portion.

17. The screening panel of claim 14, wherein each of the plurality of raised members is disposed adjacent at least one of the plurality of raised cross-members.

18. The screening panel of claim 14, wherein the peripheral frame includes a plurality of the raised members and a plurality of the raised cross-members, the raised members and raised cross-members extending from the upper surface of the peripheral frame.

19. The screening panel of claim 18, wherein several of the plurality of raised members and raised cross-members included on the peripheral frame extend from the ribs and cross-ribs to the peripheral frame.

20. The screening panel of claim 14, wherein the screening panel is formed of a resiliently deformable polymeric material.

* * * * *